US005575220A

United States Patent [19]

van Soest et al.

[11] Patent Number: 5,575,220

[45] Date of Patent: Nov. 19, 1996

[54] SIDE ROLLER ASSEMBLY FOR GANTRY CRANE BRIDGE WHEELS

[75] Inventors: Cornelis J. M. van Soest, Coquitlam, Canada; Robert R. Gingrasso, Renton, Wash.

[73] Assignee: Kone Wood Inc., Atlanta, Ga.

[21] Appl. No.: 492,871

[22] Filed: Jun. 20, 1995

[51] Int. Cl.[6] ..... B61H 5/50

[52] U.S. Cl. ..... 105/163.1; 104/244; 212/276; 212/346

[58] Field of Search ..... 105/163.1, 163.2; 104/243, 244, 245, 247; 212/276, 346

[56] References Cited

U.S. PATENT DOCUMENTS

| | | | |
|---|---|---|---|
| 3,050,016 | 8/1962 | Fischer | 104/245 |
| 4,505,207 | 3/1985 | Bagaric et al. | 105/163.2 |

FOREIGN PATENT DOCUMENTS

| | | | |
|---|---|---|---|
| 2627764 | 9/1989 | France | 105/163.2 |
| 785180 | 12/1980 | U.S.S.R. | 104/247 |
| 1147672 | 3/1985 | U.S.S.R. | 104/247 |
| 1654237 | 6/1991 | U.S.S.R. | 105/163.1 |
| 1813693 | 5/1993 | U.S.S.R. | 105/163.1 |

*Primary Examiner*—S. Joseph Morano
*Attorney, Agent, or Firm*—Chilton, Alix & Van Kirk

[57] ABSTRACT

A gantry truck assembly for rolling on a rail (16) where the rail has a top rail surface (42) and a side rail surface (48). The truck has a wheel (38) for rolling on the top rail surface. A flange (44) extends radially from the wheel and can contact the side rail surface (42). A side roller (56) is rotatably mounted to a lever arm (54) and is biased by a spring (62) to a position closer to the side rail surface than is the wheel flange. When a force greater than a pre-set limit is placed on the roller by the rail, the lever arm can pivot to allow the wheel flange to contact the side rail surface.

27 Claims, 5 Drawing Sheets

SIDE ROLLER ASSEMBLY FOR GANTRY CRANE BRIDGE WHEELS

BACKGROUND OF THE INVENTION

This invention relates to the field of gantry equipment. More specifically, this invention relates to the gantry drive mechanism for the movement of a gantry crane along a track.

Gantries mounted on wheel truck assemblies that roll along rails are well known in the art of materials handling. In a typical outdoor setting, a trolley is suspended from a gantry that runs along a linear horizontal track system. The gantry is supported above the ground on a truck assembly that runs on rails in a direction transverse to the motion of the crane trolley. The result is that, by a combination of the two mutually perpendicular motions, a large work area of ground may be covered for the movement of materials. The motion of the trolley on the gantry girder is limited by the length of the girder, but the motion of the gantry may be almost unlimited length because of the ability to set runway rail over a large distance.

Gantry cranes have proven to be particularly useful in the forest industry for the movement of logs at mill operations.

Due to the distance between the rails, force of the gantry wheels upon the rails, ground movements due to weather and other forces, the rails on which the gantry runs are not always maintained in perfect parallel alignment. In addition, the carrying of large masses on the trolley at different positions along the gantry girder can result in offset forces that increase the likelihood of misalignment between the runway rails and the gantry wheels.

Wheels for gantry movement are conventionally designed with a double flange to maintain the gantry on the rail should misalignment occur. Misalignment of the wheel and rail results in the side face of the rail contacting the inside flange face of the gantry wheel. This contact results in wear on the flange face which eventually requires expensive wheel replacement.

To extend the operating life of gantry wheels, fixed side rollers have been employed to contact the side of the rail during periods of misalignment and to absorb transverse forces that would be absorbed by flange absent the use of a side roller. Side rollers either could replace or supplement the gantry wheel flange. Wear on a side roller is generally preferred due to the lower cost and the easier replacement of a side roller. Side rollers can be replaced without removing the gantry wheels from the track and therefore result in decreased down time for the gantry. Without the employment of a side roller, the forces of misalignment must be absorbed by the flange of the main gantry wheel contacting the side of the rail. These fixed side rollers have been employed with little or no success. Stresses caused by the runway rail misalignment, imperfections in the various components and dynamic forces result in large unpredictable stress spikes which break the roller assembly. While stresses have less catastrophic impact on the rotating treads of the wheels, the flange to rail contact will act, over time to grind and wear the flanges down by non-rolling metal-to-metal contact, thus requiring a costly premature gantry wheel change. The more out of alignment the system becomes, the faster the wear on the flange and the sooner or more frequent the costly gantry wheel replacement must be undertaken.

An object of the invention is to provide a practical side roller assembly for absorbing forces as a result of rail and gantry wheel misalignment, reduce flange wear and thereby increase wheel life.

Another object of the invention is to provide a system able to indicate to the crane operator misalignment between the wheels and rail.

Yet another object of the invention is to provide a side roller that is of lower cost and simpler to replace than a gantry wheel.

A further object of the invention is to provide a system of side rollers that withstands unpredictable peak stresses without failure.

These and other objects of the invention are accomplished by the following disclosed invention.

SUMMARY OF THE INVENTION

The gantry wheel assembly of the invention employs a double flanged main gantry wheel rolling on the top surface of a rail. The flanges on each side of the gantry wheel extend radially from the wheel to contact the side faces of the rail should misalignment of the gantry and the rail occur. Affixed to the gantry wheel assembly are side rollers pivotally mounted on the truck assembly sides for contact with the side of the runway rail should wheel and rail misalignment occur. The axis of rotation of the side rollers is generally orthogonal to that of the main gantry roller, or may be described as generally perpendicular to the ground on which the rail runs. The side rollers are disposed in such a manner that should a misalignment occur, the side roller will contact the side face of the rail in rolling contact before the flange of the main gantry wheel contacts the side of the rail in sliding contact.

In the preferred embodiment, the side roller is mounted to a lever arm that pivots on an axis above and generally parallel to the rail. Mounted to the other end of the lever arm is a spring or other force producing mechanism that biases the side roller toward the side face of the rail. During operation of the gantry, should a misalignment occur between the rail and the truck wheel, the side roller will contact the side face of the rail to absorb the transverse force. When the transverse or misalignment force exceeds a preset limit, the side roller will pivot on the lever arm. The transverse force acting on the pivot arm overcomes the force of the spring mechanism and allows the side face of the rail to contact the inside face of the flange of the main wheel. In this manner, large stresses that would break a fixed side roller can be safely transferred to the mechanically stronger flange of the gantry wheel.

In the preferred embodiment, sensors are provided to warn of misalignment. When the misalignment force exceeds the preset limit, a sensor indicates to the crane operator that a misalignment is occurring, therefore allowing the crane operator to change the operating conditions of the crane or, perform repairs on the crane and rails to bring the rails and wheels back into alignment.

DETAILED DESCRIPTION OF THE DRAWINGS

Figure 1:
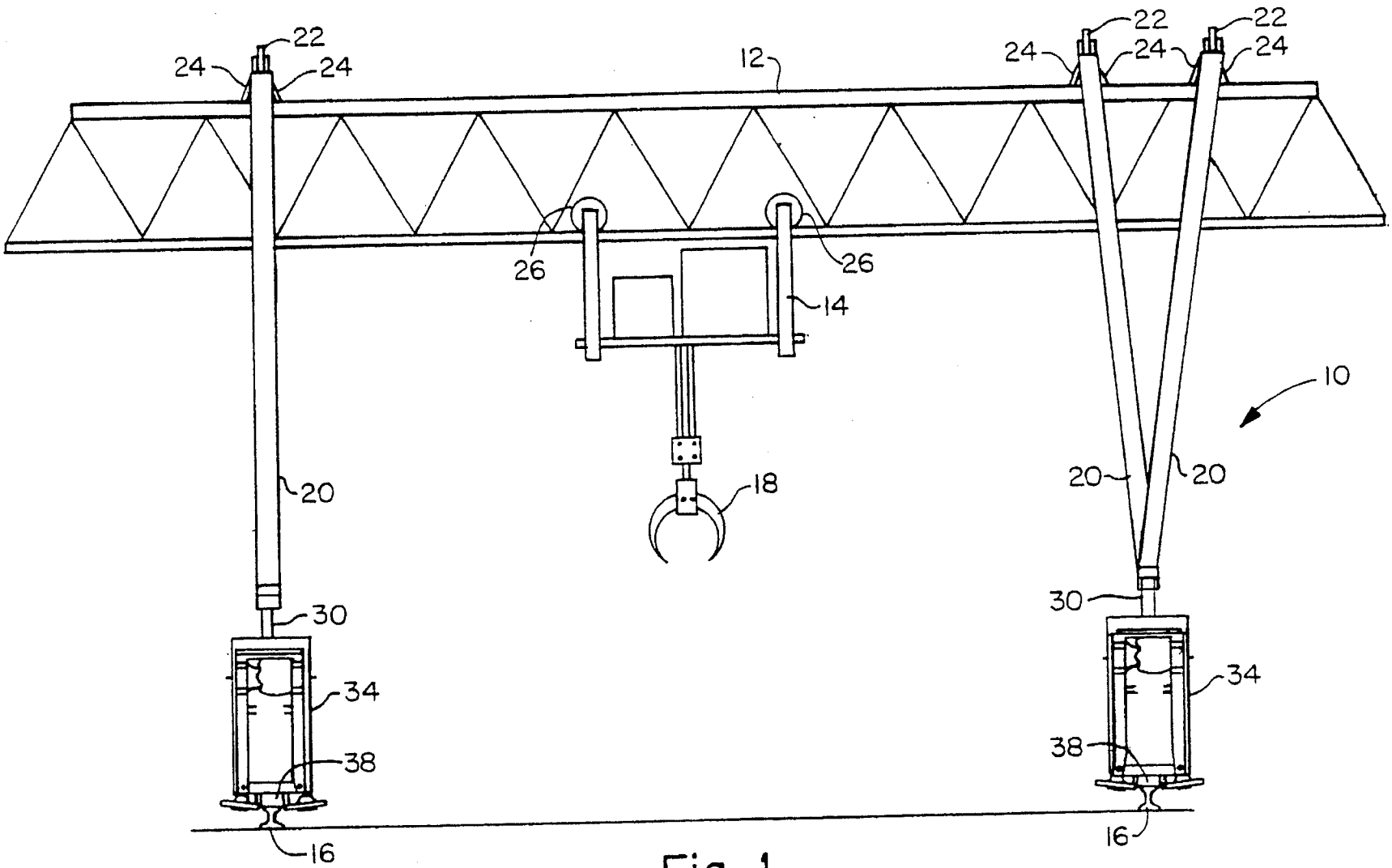
FIG. 1 is a partial, schematic, cut away, elevation view of a log crane having a gantry on an associated truck assembly.
Figure 2:
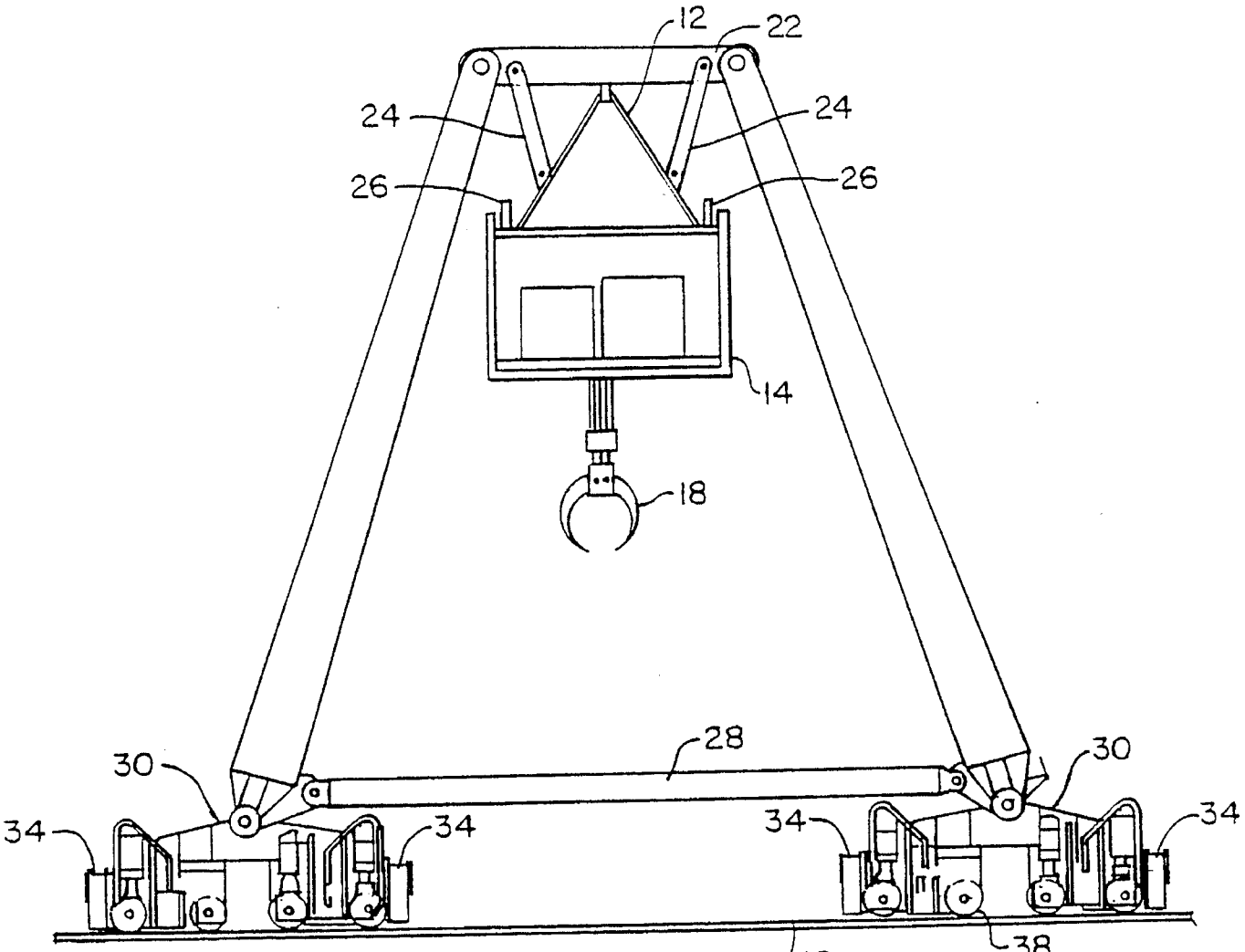
FIG. 2 is a partial, schematic, cutaway, side view of the log crane having a gantry on an associated truck assembly of FIG. 1.
Figure 3:
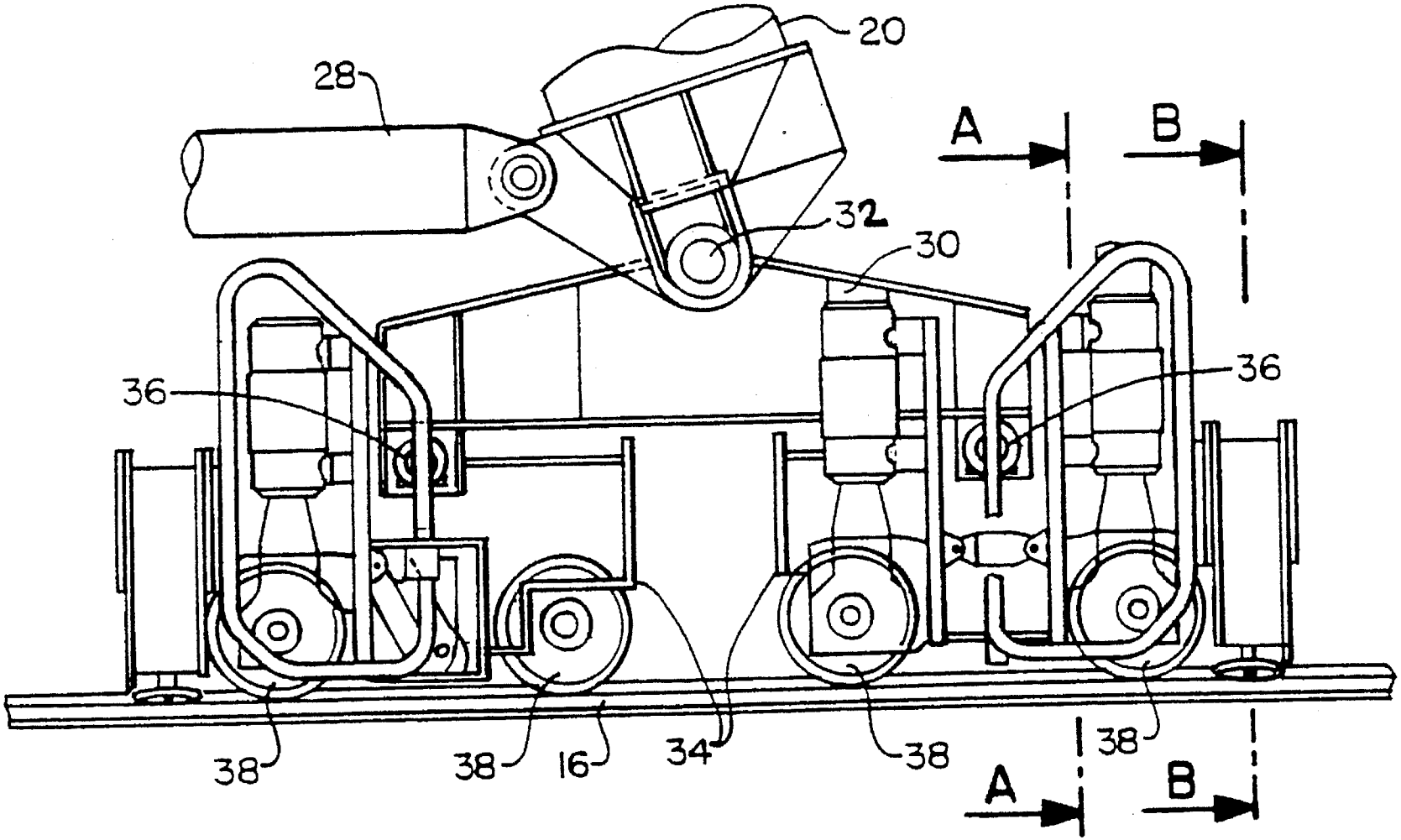
FIG. 3 is a schematic cutaway side view of the truck wheel assembly of FIG. 1.
Figure 4:
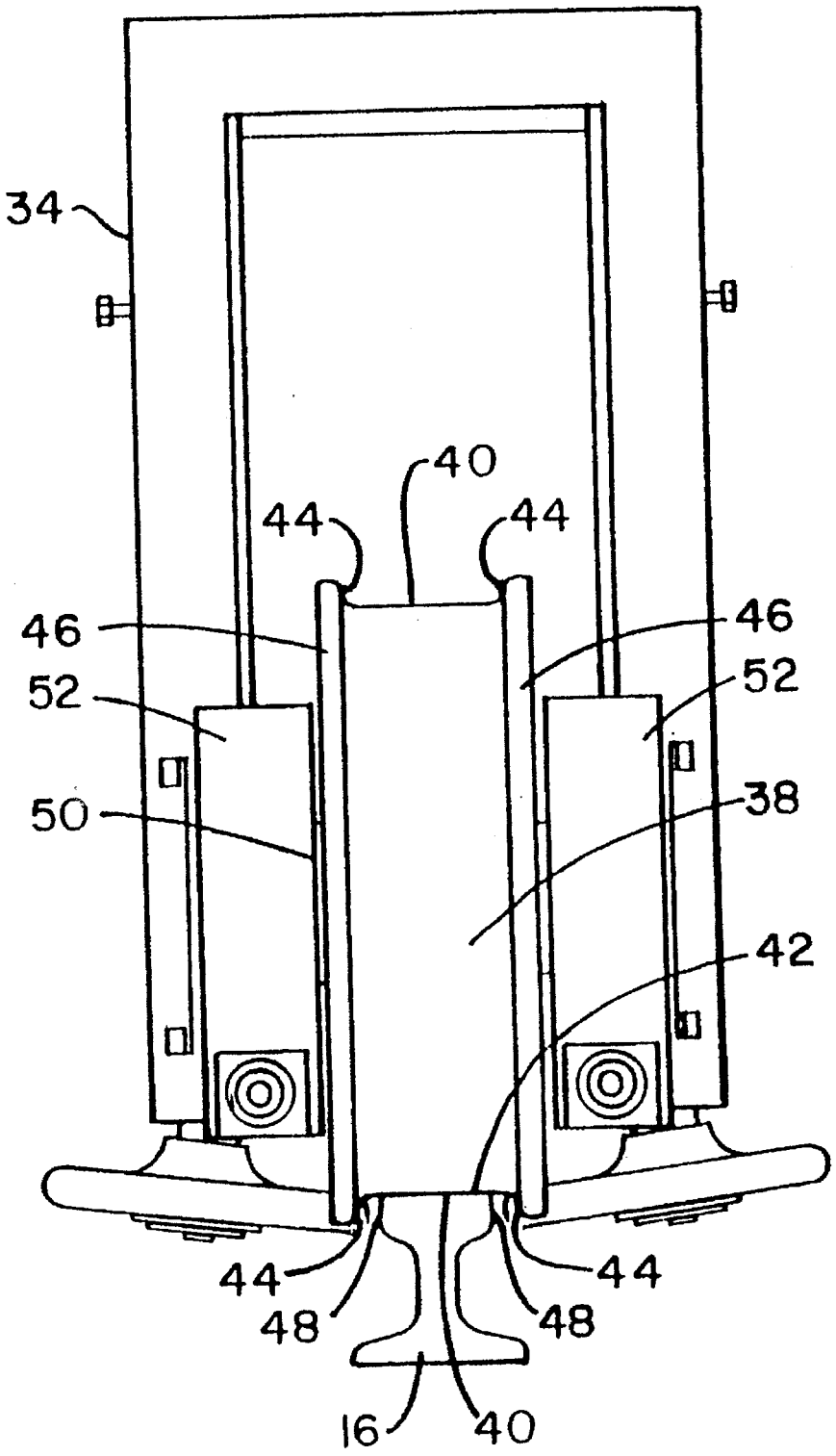
FIG. 4 is a cross-sectional schematic view taken at A of the truck wheel assembly of FIG. 3.
Figure 5:
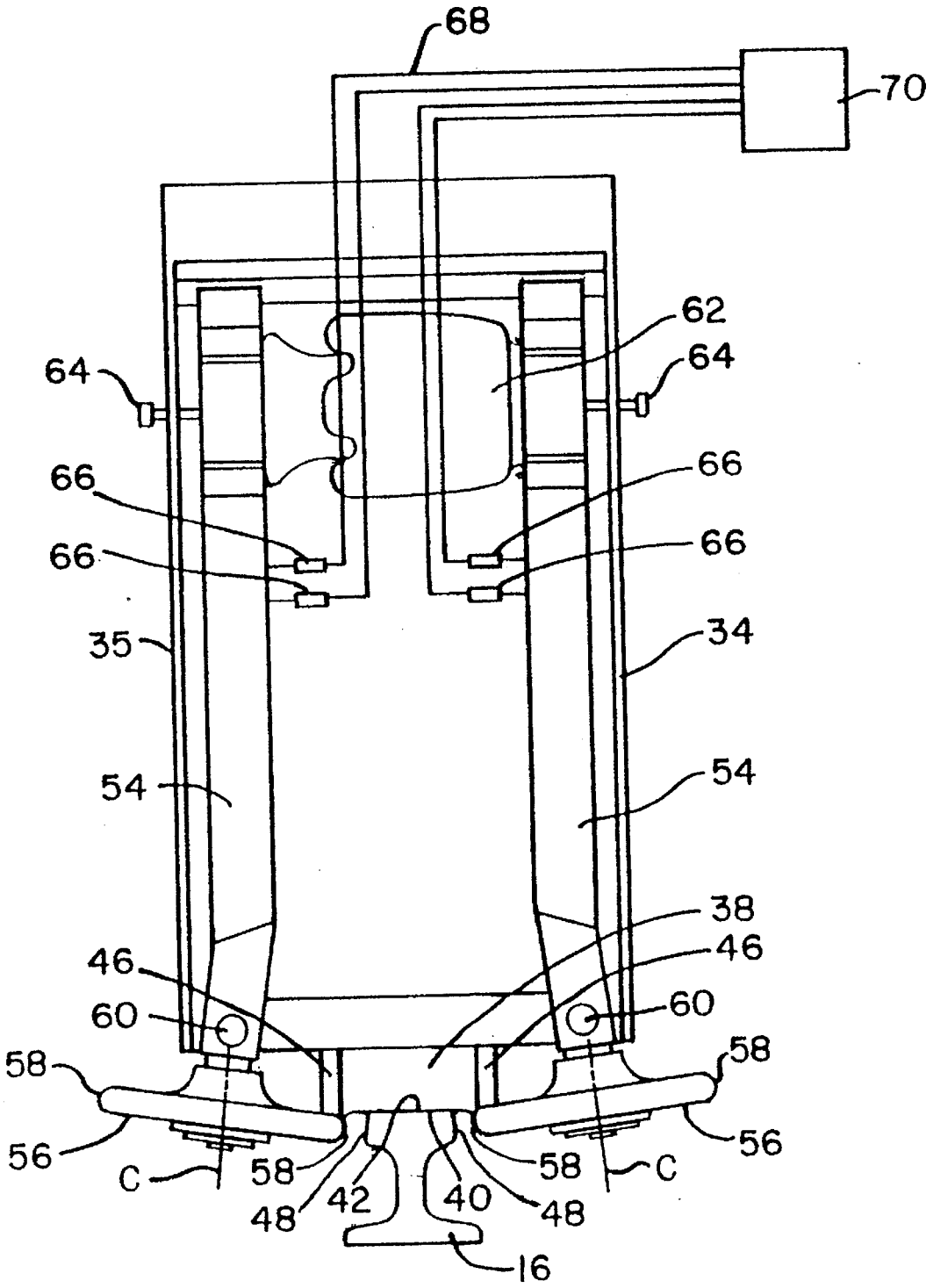
FIG. 5 is a partial schematic cutaway taken at B of the truck wheel assembly of FIG. 3.

With reference to the figures and where like numerals represent like parts in each figure, the log crane system is represented by the numeral 10.

The main gantry girder 12 supports a rolling trolley hoist mechanism 14. The trolley hoist 14 moves along the main girder 12 in a direction generally transverse to the runway rails 16. The trolley hoist 14 can employ any number of grabbing mechanisms such as a log grapple 18. The hoist could also be fitted with electromagnets, shovels, grab hooks or other similar mechanisms.

The girder 12 is supported above the ground by supporting legs 20 having a support beam 22 and support bracing 24. The gantry-girder 12 has typically a triangular girder type construction for superior strength characteristics. The trolley hoist 14 runs on wheels 26 along the gantry girder 12. The gantry girder 12 is designed in a manner that the hoist mechanism may run out beyond the main support legs 20 and be cantilevered over the ground outside of the rails 16 so as to be capable of lifting materials over a greater area. The bottoms of the main support legs are linked by a main member sill beam 28 running generally parallel to the rails 16.

The gantry moves along the rails 16 by truck assemblies located at the end of each main support leg 20. Main support leg 20 is linked to the central equalizer beam 30 by use of a main support pin 32. Pivotally linked between the equalizer beam and the rails are two-wheel bogie trucks 34. The truck pins 36 also pivot so that even due to elevational misalignment, the trucks 34 are always in full contact with the rail 16 as the crane moves on the rails. Each truck 34 rotatably supports a pair of gantry wheels 38. The gantry wheels 38 have a wheel tread 40 for contact with the top surface 42 of rail 16. Additionally, the wheels 38 have double flanges forming two inner flange faces 44 on each of the flanges 46 of a gantry wheel 38. The inner flange surfaces 44 are preferably shaped to the same profile as the sides of the rail to result in intimate contact with the side portions 48 of the rail 16 should misalignment of the rail 16 and a gantry wheel 38 occur. The gantry wheel 38 is supported in the truck bogie on an axle 50 rotatably fixed to wheel bearings 52.

Pivotally connected to the truck 34 by lever arms 54 are side rollers 56. Side rollers 56 have a side roller face 58 for rolling contact with a side rail surface 48. Side rollers 56 rotate along in axis C which is generally parallel to the side rail surface 48 and generally perpendicular to the rail top surface 42. The side roller face 58 is positioned in the preferred embodiment to be ⅛ inch (0.3 cm) closer to the side rail surface 48 than the inside flange base 44. Therefore, when misalignment occurs between the gantry wheel 38 and the rail 16, side roller surface 58 comes into contact first with side rail surface 48 before inner flange surface 44 contacts side rail surface 48.

Lever arm 54 can rotate on the pivot 60 which has an axis of rotation generally parallel with the longitude of rail 16. At the distal end of lever arm 54 from side roller 56 is a spring or biasing system 62. Biasing system 62 can be simply a spring or in the preferred embodiment an air pressure driven spring. The biasing mechanism 62 biases the lever arm 54 up against stop 64. Stop 64 in the preferred embodiment is a bolt threaded through the truck frame 35 to adjustably change the position of the side roller 56 at the proximal end of lever arm 54. Adjustment of stop 64 varies the position of side roller face 58 with relation to inner flange surface 44 and side rail surface 48 preferably being ⅛ inch (0.3 cm) closer.

Biasing mechanism 62 is regulated at a preset limit so that when side rail face 48 contacts side roller face 58 at greater than a preset force, lever arm 54 can rotate on pivot 60 to overcome the preset biasing force of biasing mechanism 62 and allow side roller 56 to move so that side rail face 48 can contact inner flange surface 44. The preset limit is a mean value of 10% of the maximum wheel load. The advantage of allowing side roller 56 to move is that side roller 56 will generally receive most of the wear for misalignment of the gantry wheel and rail 16. However, when peak forces of misalignment would cause damage to side roller 56, side roller 56 can pivot to allow the flange of the main gantry wheel and the side roller together to absorb these excess forces. Therefore, during normal operation of the crane 10 most of the wear occurs on the less expensive and more easily replaced side roller 56 than on the flange of trolley wheel 38.

Additionally, sensors 66 measure the swing motion of lever arm 54. In the preferred embodiment, two sensors are employed on each lever arm 54. The first indicates any movement of lever arm 54 and signals over line 68 to warning indicator 70 that some misalignment is occurring between the rail and gantry wheel. The second sensor indicates when lever arm 54 has moved sufficiently that side rail surface 48 is contacting inner flange surface 44, therefore indicating a greater degree of misalignment. A warning system 70 receiving signals from sensors 66 can generally be located in the operator's booth of the gantry system (not shown). Therefore, by use of sensor 66, an operator of the gantry can determine whether misalignment is occurring to the left gantry trucks or to the right gantry trucks and the degree of misalignment, therefore facilitating early repair and realignment of the runway rails 16 so as to decrease the wear on the gantry wheel and side rollers, therefore decreasing maintenance costs. In the preferred warning system, the sensor signal is compared to the speed of the crane to determine by use of an algorithm if the operator needs to be warned of the misalignment.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A gantry truck assembly for rolling on a rail having a top rail surface and a side rail surface, said gantry truck comprising:

a bogie frame;

a flanged wheel rotatably mounted to said frame, said flanged wheel defining a wheel face for rolling contact on said top rail surface and a flanged face generally perpendicular to said wheel face, said flange face adapted for intermittent contact with said side rail surface;

a side roller means for contact with said side rail surface, said side roller means comprising a roller;

a side roller support means for rotatably supporting said side roller means in a first position whereby said side roller means is closer to said side rail surface than is said flange face, and is movable from the first position to a second position to allow said flange face to contact said side rail surface; and sensor means for indicating contact between said flange face and said side rail surface.

2. The gantry truck assembly of claim 1 wherein said side roller support means comprises a lever arm pivotably mounted to said frame, said lever arm having a first end and a second end, said side roller means is rotatably mounted to said first end of said lever arm, and spring means contact said second end of said lever arm for biasing said side roller support means to said first position.

3. The gantry truck assembly of claim 2 wherein said sensor means are mounted at said second end of said lever arm.

4. The gantry truck assembly of claim 2 further comprising adjustment means for adjusting said first position of said side roller support means relative to said side rail surface.

5. The gantry truck assembly of claim 2 wherein said spring means comprises an air pressure driven spring.

6. The gantry truck assembly of claim 1 further comprising second sensor means for indicating contact between said side roller and said side rail surface.

7. The gantry truck assembly of claim 1 wherein said side roller support means support said side roller approximately 0.3 cm closer to said side rail surface than said flange face is to said side rail surface.

8. The gantry truck assembly of claim 1 further comprising adjustment means for adjusting said first position of said side roller support means relative to said side rail surface.

9. A gantry truck for rolling on a rail which has a top surface and a side surface, said truck comprising:

a flanged wheel means for rolling on the rail, said wheel means defining a wheel face for rolling on the top surface of said rail and a flange face extending radially from said wheel face and spaced adjacent to the side surface of said rail for intermittent contact with said side surface of said rail;

a side roller for contacting said side surface of said rail, said side roller defining a side roller axis of rotation generally orthogonal to a wheel axis of rotation;

side roller support means comprising first support means for rotatably supporting said side roller closer to said side surface of said rail than said flange face, and movement means for allowing said side roller to move from a position closer to said side surface of said rail than said flange face, to a position where said flange face contacts said side surface of said rail; and sensor means for indicating contact of said flange face and said side surface of said rail.

10. The gantry truck of claim 9 wherein said first support means comprises a lever arm.

11. The gantry truck of claim 10 wherein said movement means comprises a pivot mounted to said lever arm.

12. The gantry truck of claim 9 wherein the movement means comprises a pivot.

13. The gantry truck of claim 9 further comprising second sensor means for indicating contact of said side roller and said rail.

14. A gantry truck assembly for rolling on a rail having a top rail surface, a first rail side surface and a second rail side surface, said gantry truck comprising:

a bogie frame;

a double flanged wheel rotatably mounted to said frame, said double flanged wheel defining a rolling face and two flanged faces, each flanged face radially extending from said rolling face and spaced apart from one of said rail side surfaces;

a first side roller for rolling contact with said first side surface of said rail;

a second side roller for rolling contact with said second side surface of said rail;

a first side roller support means for rotatably supporting said first side roller in a first position whereby said side roller is closer to said first side surface of said rail than is a first said flange face, and movable to a second position wherein said first flange face contacts said rail first side surface;

a second side roller support means for rotatably supporting said second side roller in a first position whereby said side roller is closer to said second side surface of said rail than is a second said flange face, and movable to a second position wherein said second flange face contacts said second side surface of said rail; and sensor means for sensing contact of one of said flange faces with one of said side rail surfaces.

15. The gantry truck assembly of claim 14 wherein each of said side roller support means comprises a lever arm pivotably mounted to said frame, said arm having a first end and a second end, each of said side rollers being rotatably mounted to said first end of each of said respective lever arms, and a plurality of spring means for biasing each of said side roller support means to each of said first positions.

16. The gantry truck assembly of claim 15 further comprising second sensor means for sensing contact of one of said side rollers with one of said rail side surfaces.

17. The gantry truck assembly of claim 14 further comprising a plurality of biasing means for biasing said first roller support means to said first position of said first side roller, and biasing said second roller support means to said first position of said second side roller.

18. A gantry truck assembly for rolling on a rail having a top rail surface and a side rail surface, said gantry truck comprising:

a bogie frame;

a flanged wheel rotatably mounted to said frame, said flanged wheel defining a wheel face for rolling contact on said top rail surface and a flanged face generally perpendicular to said wheel face, said flange face adapted for intermittent contact with said side rail surface;

a side roller means for contact with said side rail surface, said side roller means comprising a roller; and a side roller support means for rotatably supporting said side roller means in a first position whereby said side roller means is closer to said side rail surface than is said flange face, and is movable from the first position to a second position to allow said flange face to contact said side rail surface, said side roller support means comprising a lever arm pivotably mounted to said frame, said lever arm having a first end and a second end and a pivot between said first end and said second end, said side roller means rotatably mounted to said first end of said lever arm, and spring means contacting said second end of said lever arm for biasing said side roller support means to said first position.

19. The gantry truck assembly of claim 18 wherein said side roller support means support said side roller approximately 0.3 cm closer to said side rail surface than said flange face is to said side rail surfaces.

20. The gantry truck assembly of claim 19 further comprising adjustment means for adjusting said first position of said side roller support means relative to said side rail surface.

21. The gantry truck assembly of claim 18 further comprising adjustment means for adjusting said first position of said side roller support means relative to said side rail surface.

22. The gantry truck assembly of claim 18 wherein said spring means comprises an air pressure driven spring.

23. The gantry truck assembly of claim 18 wherein said pivot means is closer to said first end than to said second end.

24. A gantry truck for rolling on a rail which has a top surface and a side surface, said truck comprising:

a flanged wheel means for rolling on the rail, said wheel means defining a wheel face for rolling on the top surface of said rail and a flange face extending radially from said wheel face and spaced adjacent to the side surface of said rail for intermittent contact with said side surface of said rail;

a side roller for contacting said side surface of said rail, said side roller defining a side roller axis of rotation generally orthogonal to a wheel axis of rotation;

side roller support means comprising first support means for rotatably supporting said side roller closer to said side surface of said rail than said flange face, said first support means comprising a lever arm having a first and a second end, said side roller rotatably mounted to said first end, and movement means for allowing said side roller to move from a first position closer to said side surface of said rail than said flange face, to a second position where said flange face contacts said side surface of said rail, said movement means comprising a pivot mounted to said lever arm between said first end and said second end of said lever arm and spring means contacting said second end to urge said side roller to said first position.

25. The gantry truck of claim 24 wherein said pivot means is closer to said first end than to said second end.

26. The gantry truck of claim 24 further comprising adjustment means for adjusting said first position of said side roller support means relative to said side surface of said rail.

27. The gantry truck of claim 24 wherein said spring means comprises an air driven spring.

* * * * *